United States Patent [19]

Frear

[11] Patent Number: 4,552,232

[45] Date of Patent: Nov. 12, 1985

[54] DRILL-BIT WITH FULL OFFSET CUTTER BODIES

[75] Inventor: Lawrence Frear, Sandy, Utah

[73] Assignee: Spiral Drilling Systems, Inc., Denver, Colo.

[21] Appl. No.: 626,237

[22] Filed: Jun. 29, 1984

[51] Int. Cl.[4] ..... E21B 10/10

[52] U.S. Cl. ..... 175/337; 175/350; 175/361; 175/377; 175/372

[58] Field of Search ..... 175/337, 350, 353, 361, 175/377, 371, 372

[56] References Cited

U.S. PATENT DOCUMENTS

| | | | |
|---|---|---|---|
| 1,124,242 | 1/1915 | Hughes | 175/377 |
| 1,789,834 | 1/1931 | Paulsen | 175/350 |
| 1,866,082 | 7/1932 | Carlson | 175/337 |
| 2,174,587 | 10/1939 | Love | 175/353 |
| 2,182,247 | 12/1939 | Catland | 175/361 |
| 2,528,300 | 10/1950 | Degner | 175/377 |
| 2,687,875 | 8/1954 | Morlan et al. | 175/377 |
| 3,199,878 | 8/1965 | Cunningham et al. | 175/371 |
| 3,299,973 | 1/1967 | Swart et al. | 175/371 |
| 4,109,737 | 8/1978 | Bovenkerk | 175/329 |
| 4,161,225 | 7/1979 | Mitchell | 175/374 |

*Primary Examiner*—Stephen J. Novosad
*Assistant Examiner*—M. Goodwin
*Attorney, Agent, or Firm*—Gregg I. Anderson

[57] ABSTRACT

A rotary drag drill bit is seen wherein cutter bodies are rotatively connected to a main body structure at a fully offset position. The fully offset position is defined by a rotational axis of each cutter body, a longitudinal axis of the drill bit and end support points or positions of the cutter bodies. The rotational axes of the cutter bodies are perpendicular to the longitudinal axis of the drill bit. The end supports of the cutter body are each equal distance from any point on the longitudinal axis of the drill bit. The cutter bodies of essentially ellipsoidal configuration, being slightly thicker at a mid-portion thereof. Cutting elements are connected to flutes projecting above an outer surface of each cutter body. In a primary rotational direction of the drill string and drill bit, the rows abrade the bottom and side walls of a well bore as the cutter body attacks the earth formation as the drill bit is rotated. The impingement of the cutting elements of the cutter body on the earth formation imparts a secondary rotation to the cutter bodies, which secondary rotation is induced by the primary rotation. The secondary rotation allows the rows of cutting elements to engage the side wall of the bore and gauge the hole as well as abrading away material from the bottom of the well bore. A roller bearing assembly is provided for the cutter body to permit the secondary rotation, while a thrust bearing assembly assists the primary abrasive action imparted by the primary rotational movement of the rotary drill bit. A lubrication system is included in the main body structure of the drill bit wherein both the roller bearing assembly and thrust bearing assembly are lubricated.

33 Claims, 14 Drawing Figures

DRILL-BIT WITH FULL OFFSET CUTTER BODIES

BACKGROUND OF THE INVENTION

1. Field of the Invention

The present invention pertains to rotary drill bits employed for coring and drilling well bores in an earth formation. More particularly, the present invention pertains to an improved arrangement and shape of cutter bodies, and attached cutter elements, in which arrangement the cutting elements are oriented to impart a secondary rotation to the cutter body, while each cutter body is simultaneously rotating with a primary rotation around a longitudinal axis of a drill string, cutting away and crushing the earth formation being drilled.

2. Brief Description of the Prior Art

The cutter body employed in prior art rotary drill bits is rotatively connected, in groups of two or more, to a main body structure. Each cutter body is generally of conical or frustoconical-shape, a base of the cutter body positioned at the outside of the drill bit to gauge the size of the hole being drilled. Cutting elements or teeth are attached to or formed on the exterior surface of each cutter body. The cutting elements are rotated about a rotational axis of the cutter body, and in a rotation about a longitudinal axis of a drill string, to engage an earth formation being drilled. The contact of the cutting elements with the earth formation during rotation loosens particulate matter or cuttings for removal by drilling fluids in a conventionally known manner.

In some of the prior art, the rotational axis of each cutter body passes through the longitudinal axis of the drill string, the drill string being rotated to drill the earth formation. Each cutter body rotates in direct proportion to the primary rotation of the drill string about the longitudinal axis. Very little abrasive cutting action bears on the well bore being drilled. The proportional relationship is virtually the same relationship as exists between a wheel and axle, as the drill string rotates, the cutter body rotates. The primary force acting to abrade away and remove the particulate matter is the weight of the drill bit and drill string producing a crushing type of action. Little abrasion is imparted to the formation by the rotation of each cutter body.

It is known in the prior art to move or offset the rotational axis of each cutter body so that the axis does not pass through the longitudinal axis of the drill string. Offsetting the rotational axis of each cutter body increases the abrasion, or scraping, force of the rotary drill bit against the earth formation. The offset cutter body of the prior art has heretofore been small enough that a primary component of the rotation of the cutter body remains proportional to the rotation of the drill string.

An axis of rotation of the cutter body perpendicular to the primary rotational axis and with the rotational end supports of each cutter body equi-distant from the longitudinal axis of the drill string, is seen in a well reamer, U.S. Pat. No. 2,174,587 to D. Love. As used herein, this orientation is defined as fully offset. The well reamer of Love is not a rotary drill bit, but rather is used to enlarge the bore hole formed by a rotary drill bit. Love therefore does not act on the bottom of the bore hole itself but rather only at the periphery thereof, after the hole has been drilled.

The patent to C. Reed, U.S. Pat. No. 1,236,982, shows rotational axes for a pair of cutter bodies perpendicular to the longitudinal axis of a drill stem in a rotary drill bit. The cutter body elements are not fully offset, in that the cutter body end support points are not equi-distant from the longitudinal axis of the drill string. Reed does show spiral teeth or cutter elements that apparently impart a rotation to each cutter body. The imparted rotation of each cutter body remains proportional to the rotation of the drill string. The two cutter bodies of Reed have cutter elements of opposite angular orientation along the cutter body surface so that one cutter body does not track the previously made cutting pattern. Other cutter body cutter elements of spiral tooth orientation are known. Skewed teeth are seen in H. Mitchell, U.S. Pat. No. 4,161,225.

A rotary cutting action as well as a crushing or abrading action is seen in H. Hughes, U.S. Pat. No. 1,124,242. Hughes uses both crushing rollers and cutter bodies to provide both rotary and crushing action. A combination rotary and percussion drill bit in S. Skidmore, U.S. Pat. No. 3,885,638, wherein helical grooves extend the length of the generally frustoconically-shaped bit. Skidmore apparently would be used with a drill string but is not a multiple cutter body rotary bit.

The patent to B. Munson, U.S. Pat. No. 4,408,671 shows variation of taper and angle of the teeth between cutter bodies. Different numbers of teeth between cutter bodies are seen in J. Strauss et al, U.S. Pat. No. 1,045,756, while F. Phelps, U.S. Pat. No. 4,187,922 varies the angle of the various teeth or cutter elements.

Of general interest in rotary drill bits are the patents to R. Evans, U.S. Pat. No. 4,148,368, B. Austin, U.S. Pat. No. 3,468,583, H. Bovenkerk, U.S. Pat. No. 4,109,737 and W. Daniels et al U.S. Pat. No. 4,333,540.

OBJECTS AND SUMMARY OF THE INVENTION

The principal object of the invention is to provide a rotary drill bit with improved adhesive force at a side wall and bottom of a well bore or core made through an earth formation.

It is a related object of the invention to provide a rotary drill bit that, during a drag method of operation, moves each cutter body of a group of cutter bodies by reason of the rotation of a drill string, resulting in the abrasive force.

It is a further related object of the invention to provide a rotary drill bit with a cutter body rotational axis perpendicular to a radial reference from the primary rotational axis of a drill string which primary rotation moves the cutter body.

It is a still further object of the invention to provide a drill bit having a primary abrasive action imparted by the primary rotation of the drill string and secondary abrasive action imparted by the secondary rotation of each cutter body. The secondary rotation results from the primary rotation of the drill string, a full offset orientation of each cutter body and the orientation of cutting elements of the cutter body.

It is a still further related object of the invention to provide a rotary drill bit wherein the cutter bodies are fully offset, i.e., perpendicular to the primary rotational axis of the drill string with cutter body end support points equi-distant from the primary rotational axis.

It is another object of the invention to provide a rotary drill bit bearing system for the cutter bodies applying abrasive force in the primary rotational direction and also for the secondary rotation about the cutter body axis.

It is another related object of the invention to provide a lubrication system for the bearing system of the cutter body, extending the life and wear of the cutter bodies of the drill bit.

In accordance with the objects of the invention, a drag rotary drill bit includes a main body structure including a fluid passageway along a longitudinal axis thereof for receipt of drilling fluids. The main body structure includes provision for connection to an elongated drill string and has an interior opening within which a plurality of cutter bodies are rotatably mounted.

The cutter bodies are mounted to the main body between two end support points. An axis of rotation of the cutter bodies is generally oriented perpendicular to any line connecting the longitudinal axis of the drill bit and the axis of rotation. The cutter bodies are further oriented in a fully offset position wherein two end support points of each rotatable cutter body are equi-distant from any given point along the longitudinal axis of the drill bit. During the rotation of the drill string and drill bit about the longitudinal axis, in a primary rotational direction, the cutter bodies move in a primary abrasive mode of operation in the direction of primary rotation of the drill string.

The cutter bodies are of ellipsoid shape with truncated ends. A plurality of cutting elements are formed on or joined to an exterior surface of each cutter body. The cutting elements are aligned in rows extending generally from one end of each cutter body to the other. The rows have a pitch or spiral, which spiral acts as a thread on a screw, to rotate each cutter body as the rows of cutting elements abrade against the well bore during the primary rotation of the drill bit. The abrasion of the rows of cutting elements against the bottom of the well bore, imparts a secondary rotation to the cutter bodies about their rotational axes in a secondary abrasive mode of operation in the direction of secondary rotation. The secondary abrasive mode gauges the bore or core by abrading away a side wall and a bottom of the earth formation.

A roller bearing assembly or system for the cutter bodies is embodied in the invention wherein a cutter body shaft is connected at either end to the main body structure of the rotary drill bit at the end support points. The cutter body is operably connected to the shaft. Bearings permit the cutter bodies to rotate in the secondary rotational direction. An annular thrust bearing having an opening for receipt of the shaft is held by the main body structure at an end of each cutter body preceding the cutter body in the primary rotational direction.

The main body structure has a lubrication system which includes a pressurized lubricant reservoir. Drilling fluid pressurizes the reservoir and keeps lubricant to all bearing parts, also compensating for losses.

DESCRIPTION OF THE PREFERRED EMBODIMENTS

Figure 1:
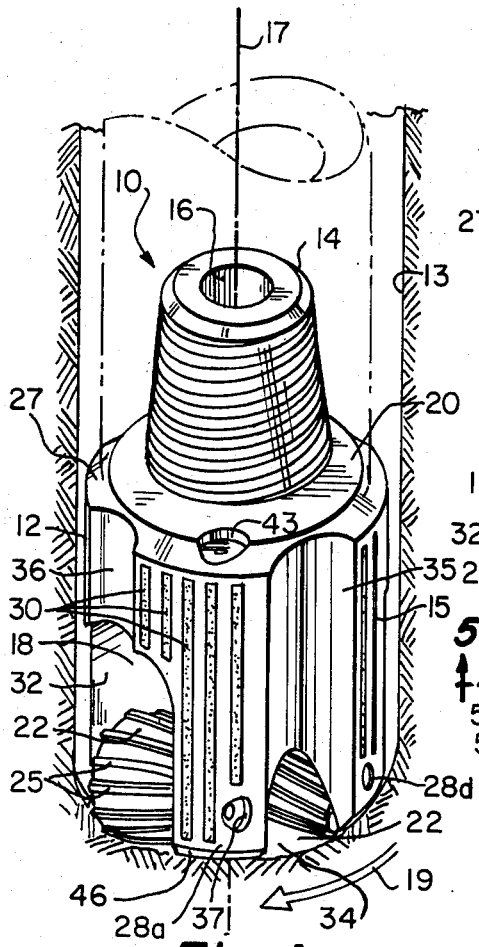
FIG. 1 is a perspective view of a rotary drag bit of the present invention.

A rotary bit 10 particularly useful in a drag mode of cutting is seen in FIGS. 1–5. The rotary bit 10 (FIGS. 1, 2 and 3) has a main body structure 12 with a threaded connector 14 and an integral generally cylindrical portion 15 extending downwardly away from the connector 14. A diameter or gauge of a well bore 13 in an earth formation is established by rotation of the drag bit 10 about a longitudinal or rotational axis 17 in a primary rotational direction indicated by arrow 19. In a conventional manner, lengths of drill pipe (not specifically shown) are connected together to comprise a drill string, which drill string is threadably connected to the rotary bit 10 at the threaded connector 14. A drilling fluid passageway 16 extends along the primary rotational axis 17 into an interior opening 18 of the main body structure 12. The passageway 16 terminates in a drilling fluid nozzle 11 (FIG. 3) at the interior opening 18.

Figure 2:
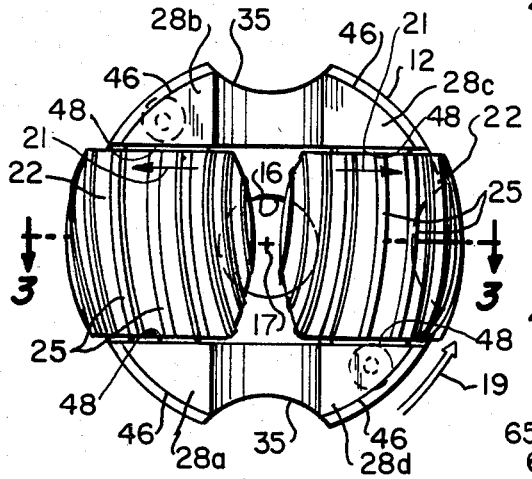
FIG. 2 is a bottom plan view of the rotary drag bit seen in FIG. 1.
Figure 5:
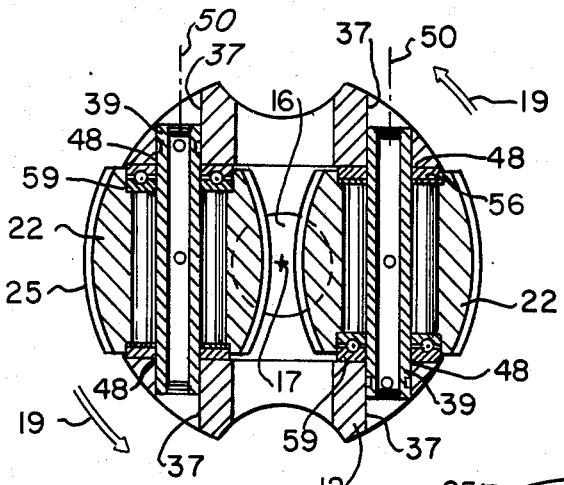
FIG. 5 is a sectional view taken in the plane of line 5—5 of FIG. 3, arrows indicating a primary direction of rotation.
Figure 6:
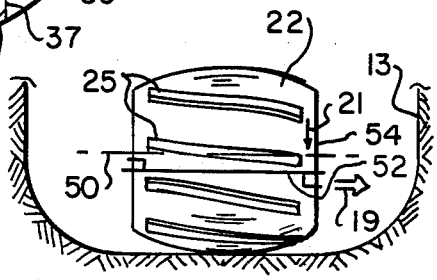
FIG. 6 is a diagrammatic view of a cutter body of the invention, arrows indicating a primary rotational directional and a secondary rotational direction of a cutter body of the rotary drag bit seen in FIG. 1.

In a conventional manner, the drill bit 10 is connected to the drill string at connector end 14, the drill string mating against a mating surface 20 of the main body structure 12 to define a rigid, essentially fluid tight, connection. The drill string and attached rotary bit 10 are rotated about the primary rotational axis 17 in the primary rotational direction indicated by the arrows 19. (FIGS. 2, 5 and 6). Drilling fluid is pumped down the drill string through the drilling fluid passageway 16 exiting the nozzle 11 into the interior opening 18 of the main body structure 12. The drilling fluid has a viscosity for purpose of lubricating the cutting action of two cutter bodies 22, to be described in more detail hereinafter. The drilling fluid also carries cuttings or particulate matter sheared from the side wall and bottom of the well bore 13 back to the surface of a drilling rig (not shown) in continuous fluid circulation, as is well known in the art.

Figure 3:
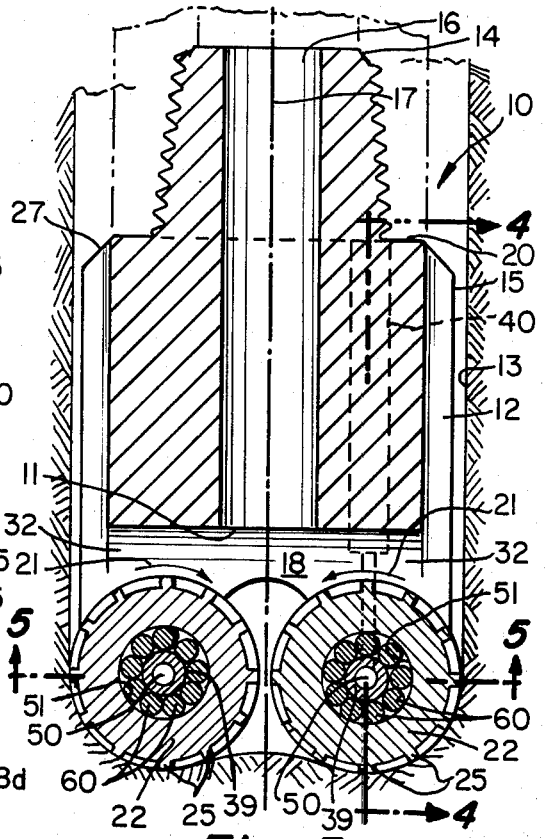
FIG. 3 is a sectional view taken in the plane of line 3—3 of FIG. 2.

The main body structure 12 has rotatively connected thereto, within the interior opening 18, two of the cutter bodies 22, though additional cutter bodies may be added. Each cutter body 22 includes a plurality of cutting elements or teeth 24 (FIGS. 8–11) formed on flutes 25 aligned in helical rows extending along the length of the cutter body 22. The helical rows of flutes 25 are so aligned along the length of the cutter body 22 as to impart a secondary rotational direction, indicated by arrow 21 in FIG. 6, to the cutter body 22 as the cutter body 22 follows the primary rotation imparted by the rotating drill string and the main body structure 12. As a result of the configuration and orientation of the cutter body 12 and cutting elements 24, abrasive cutting or shearing at the side wall and bottom of the well bore 13 occurs. The well bore 13 is also gauged by the primary and secondary rotation of the cutter bodies 22. (FIG. 3)

The main body 12 includes the threaded connector 14. The threaded connector 14 is of generally frustoconical-shape about the axis 17 of the drill bit 10 and drill string. The drilling fluid passageway 16 is formed centrally of and along the length of the threaded connector end 14, providing a passageway from the hollow interior of the pipe forming drill string to the interior opening 18 in the main body structure 12, terminating in the nozzle 11. The mating surface 20 is integrally formed with the connector 14, extending a relatively short distance away from the connector 14 in a plane perpendicular to the axis 17. The mating surfaces is to fully abut against and circumferentially seal with the drill string in a fluid tight connected configuration (not specifically shown).

A chamfered surface 27 extends from the mating surface 20, defining an edge with the mating surface 20. The cylindrical portion 15, defined by four integral elongate support fingers 28*a, b, c* and *d* (FIG. 2), extend downwardly from the termination of the chamfered surface 27. The fingers 28*a, b, c* and *d* are parallel to the axis 17. The cylindrical portion 15 has a number of stabilizer ribs 30 (FIG. 1) formed on an outer surface, which ribs 30 are abrasive material of known composition, to help gauge the well bore 13.

Between two of the fingers 28*a* and 28*b* is positioned one of the cutting bodies 22 while between the other two fingers 28*c* and 28*d* is positioned the second cutter body 22. A pair of arcuate cutter body openings 32 (FIGS. 1 and 2) are defined between the fingers 28*a* and 28*b* and between the fingers 28*c* and 28*d*. A drilling fluid outlet 34, also of arcuate shape, is formed in the main body structure 12 between each of the fingers 28*b* and 28*c* and between the fingers 28*d* and 28*a*. The drilling fluid outlets 34 are relatively smaller than the cutter body openings 32.

A return fluid flow path for drilling fluid ejected through the nozzle 11 is defined by elongate junk slots or grooves 35 and 36 formed in the main body structure 12 between each pair of adjacent fingers 28*a, b, c* and *d*. Shorter junk slots 36 provide for fluid communication between the cutter body opening 32 and the return flow path for drilling fluid between adjacent fingers 28*a* and 28*b* and between 28*c* and 28*d* respectively. Longer junk slots 35 provide for fluid communication between fluid outlets 34 and the return flow path for drilling fluid between adjacent fingers 28*b* and 28*c* and between 28*d* and 28*a* respectively. The return flow path for drilling fluid is defined by the annulus between the side wall of the well bore 13 and the outer surface of the drill string.

Figure 4:
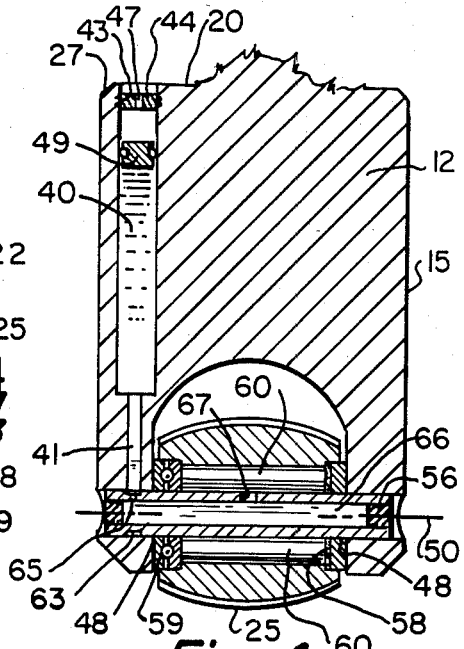
FIG. 4 is a sectional view taken in the plane of line 4—4 of FIG. 3.
Figure 7:
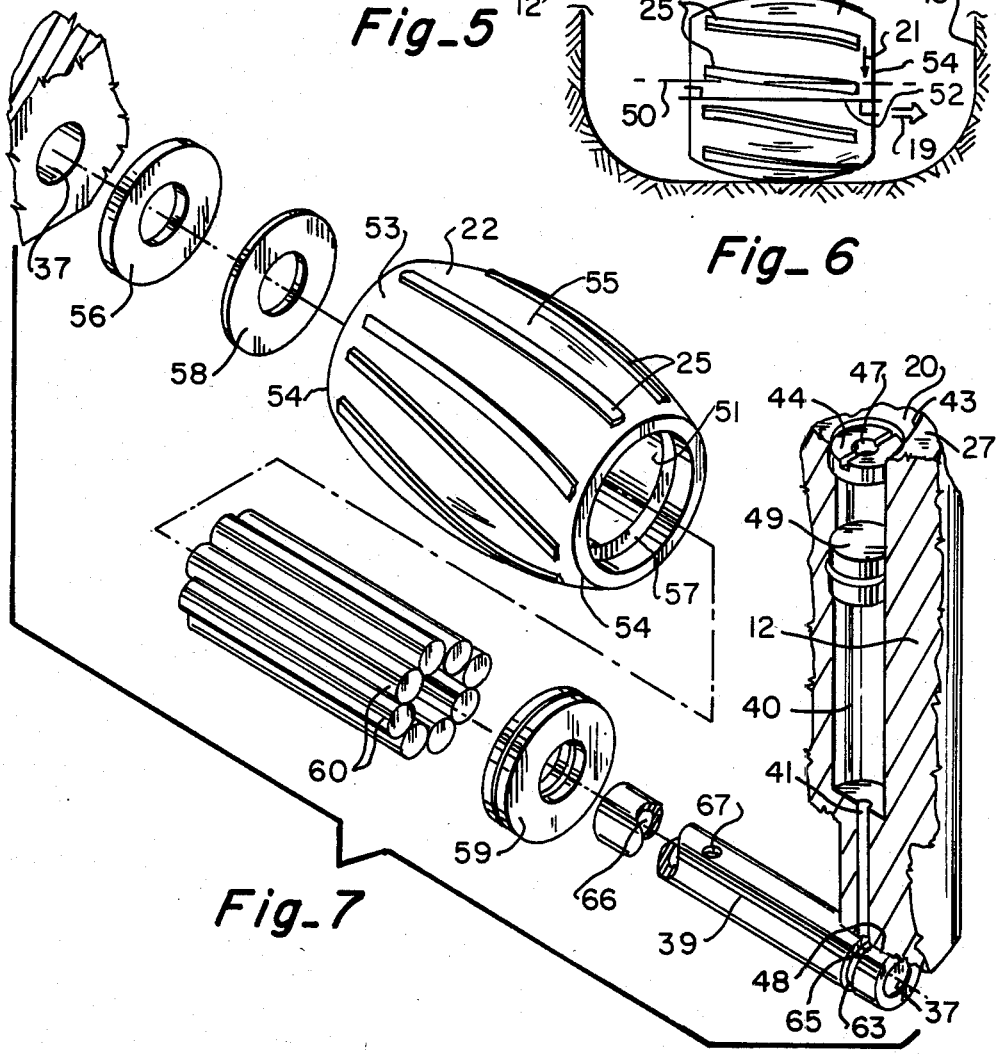
FIG. 7 is an exploded perspective view of a cutter body of the invention showing a bearing assembly and a lubrication system seen in a fragmentary sectional view.

Each of the fingers 28 is seen to be of generally triangular transverse cross-section (FIGS. 2 and 5). Each finger 28 has a bore 37 formed therethrough (FIG. 5) for receipt of a cutter body shaft 39, each shaft 39 rotatably supports one cutter body 22, as will be hereinafter described. Extending longitudinally substantially the length of the fingers 28*b* and 28*d* is an elongated generally cylindrical hollow opening defining a lubricant reservoir 40, forming part of the lubrication system to be described hereinafter. (FIGS. 4 and 7)

At a bottom end of each finger 28 a cutting edge or gauge cutter 46 is formed. A chamfered surface extends inwardly from the exterior or periphery of the main body cylindrical portion 15 to define the cutting edge 46. The cutting edge or gauge cutter 46 helps gauge the well bore 13. With respect to gauging the bore, the rotary bit 10 of the present invention does not rely totally upon the cutting action of the cutting elements of a heel row of a conventional non-offset cone type rotary bit. Rather, the cutting elements 24, along with the edge 46, gauge the bore 13.

As seen in FIG. 2, the main body structure 12, and specifically the integral fingers 28 thereof, establish four corners of a square at a bottom of the bit 10. A pair of end support points or positions 48 (FIGS. 4 and 5) exist at each end of each of the cutter bodies 22, located where each of the cutter body shafts 39 is secured to the fingers 28 by a weld or other means. The end support positions 48 for each cutter body 22 are equi-distant from the axis 17. Furthermore, a longitudinal rotational axis 50 extends longitudinally of each cutter body 22, defining an axis of evolution, and is perpendicular to a radial line extending away from axis 17. For purposes of this description, the orientation of the cutter bodies 22, as above described, is defined as fully offset with respect to the axis 17.

Each of the cutter bodies 22 is of the same generally ellipsoid shape, ends 54 of each cutter body 22 being truncated. The orientation of the flutes 25 from one cutter body to the next cutter body 22 does differ. Each cutter body 22 has a bore 51 formed longitudinally along the rotational axis 50. The bore 51 receives the cutter body shaft 39. An outer surface 53 (FIG. 7) of each ellipsoid cutter body 22 is slightly raised at a midportion 55 along the length between the two ends 54. The midportion 55 of the cutter body 22 is the location where the majority of the cutting or abrading of the earth formation takes place.

The cutting elements or teeth 24 and flutes 25 are formed on the outer surface 53 of the cutter body 22. As shown, the raised flutes are of generally rectangular cross section and project above the surface 53 to support the cutting elements 24. The flutes 25 are arranged in parallel rows. The abrasive cutting elements 24 contact and cut the earth formation in the shearing or abrading circular motion path defined by the primary rotation of the drill string and bit 10 along arrow 19 about axis 17 and in a secondary rotary or circular motion by reason of orientation of the flutes 25 of the cutting elements 24 along arrow 21 about axis 50.

Each row of cutting elements 24 is oriented with respect to an imaginary line 52 (FIG. 6) perpendicular to both ends 54. The line 52 is coincident with any given flute 25 at an end of the flute 25 which precedes the cutter body 22 in the direction of primary rotation, indicated by arrow 19. The given flute 25 makes an angle with the line 52, which angle is continuously changing along the length of the flute 25. As the bit 10 rotates in the primary direction, the flute is a finite, yet ever increasing, perpendicular distance from the line 52. The flutes function as would threads of very large pitch to rotate the cutter body 22 in the secondary rotational direction.

The abrasion cutting elements 24 are preferably of natural or synthetic diamond material type. Diamond material cutting elements are highly abrasive and highly resistive to wear in a shear or abrasion cutting mode. One example of a well known synthetic diamond material cutting element is disclosed in U.S. Pat. No. 4,156,329. Synthetic cutting elements are commercially available from General Electric Company under the trademark STRATAPAX. The cutting elements 24 can also be tungsten carbide inserts or metallic teeth integrally formed on the cutter body 22 and hardened by various metalurgical techniques which are well known.

Figure 8:
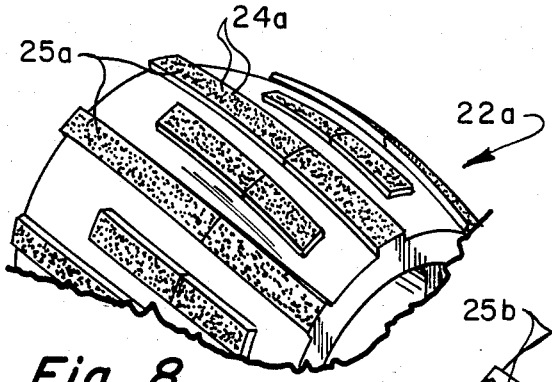
FIGS. 8–11 are perspective views of alternative cutter elements arranged on the cutter body of the rotary drag bit seen in FIG. 1.

As seen in FIG. 8, the cutting elements 24*a* are diamond, natural or synthetic, impregnated into the flutes 25*a*, which flutes are integrally formed on the cutter body 22*a*. This type of cutting element is best used for cutting a hard formation or a broken formation. Each cutter body 22, whatever cutting element 24 is used, has a different number of flutes 25 to eliminate tracking. The number of rows of flutes 25 on a given cutter body 22 will always differ from the number of rows of the other cutter body 22, the end result being no possibility of a path or track developing.

Figure 9:
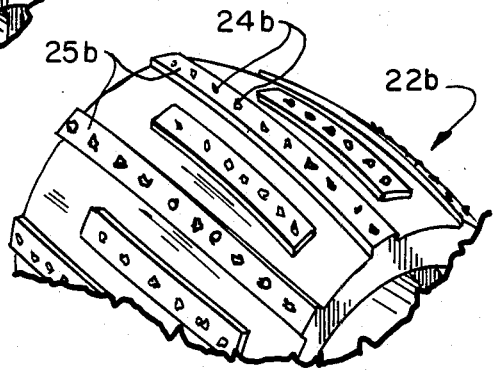

In FIG. 9 the cutter body 22*b* has cutting elements 24*b* of natural diamond, polycrystaline diamond stud or carbonade diamond. Whatever material used, is cast into the flutes 25*b*. This cutting element embodiment is used for long life in cutting hard formations.

Figure 10:
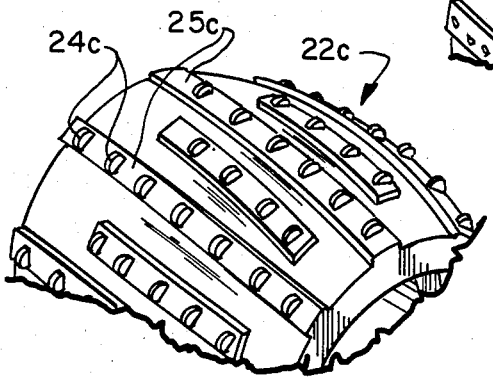

In FIG. 10 the cutter body 22*c* has cutting elements 24*c* made of polycrystalline laminated disk. The elements 24*c* are of truncated disk shape. Either silver brasing into the flutes 25*c* or erosion resistant matrix casting is used to attach them. This embodiment is useful in cutting tar sands and other rock formations with rubbery or slick properties, where other cutting elements might slide over the surface of the formation.

Figure 11:
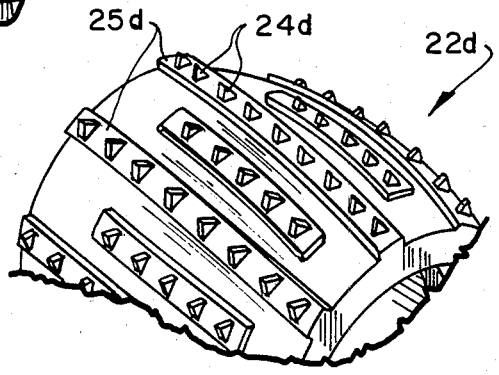

In FIG. 11 the cutter body 22*d* has cutting elements 24*d* of either aluminum oxide, tungsten carbide or cubic boron nitride (borizon). These elements are useful with soft non-abrasive formations like soft shale, limestone and coal.

As seen in FIG. 7, the flutes 25 of cutting elements 24 on the cutter body 22 spiral along the length of the cutter body 22 between the ends 54. On a given cutter body 22, the flutes 25 of cutting elements 24 are essentially parallel to each other. On the other of the cutter bodies 22, the orientation of the rows 25 is a mirror image of that of the first cutter body 22. Therefore, one cutter body 22 rotates about its rotational axis 50 in a given direction, while the other cutter body 22 rotates in the opposite direction about its rotational axis 50, all as indicated by the arrows 21 in FIGS. 2 and 3. This orientation helps prevent the secondary rotational motion of the cutter bodies 22 imparted by the flutes 25 of cutting elements 24 from tracking and allows for increased or enhanced shearing action as each cutter body 22 follows the other in the primary rotational direction indicated by the arrow 19.

At each of the ends 54 of the cutter bodies 22, a counter sunk bore 57 is formed. One end 54 receives a thrust bearing 59 as seen in FIG. 5. The other end 54 receives, in the counter sunk bore 57, a seal pack 56 and thrust washer 58. The thrust bearing 59 has a rubber seal around the circumference thereof and is mounted at the end 54 to precede the cutter body 22 in the primary direction of rotation. The thrust bearing 59, seal pack 56, washer 58, cutter body shaft 39, and roller bearings 60, form a bearing system or assembly, to be described later, for both primary rotational movement of the cutter body 22 against the thrust bearing 59 as well as secondary rotational movement around the cutter body shaft 39. (FIG. 7)

A space exists between the cutter body shaft 39 and the surface of the bore 51 of the cutter body 22 into which space the roller bearings 60 are placed. The roller bearings 60 are seen to be elongated rods of the needle type, though a journal type roller bearing could also be employed. The roller bearings 60 extend substantially the length of the cutter body 22 between the counter sunk holes 57.

The thrust bearings 59, seal pack 56 and washer 58 seal the ends 54 of the cutter bodies 22, at the counter bore 57, against loss of lubricant. The thrust bearings 59, seal pack 56 and washer 58 also hold the roller bearings 60 in place with respect to the cutter body 22.

The lubrication system for the cutter bodies 22 is best seen in FIGS. 4 and 7. The lubricant reservoir 40 is connected by a relatively smaller diameter lubricant passageway 41 within the cutter body shaft 39, which shaft 39 is positioned within the bore 37 and fixedly connected to the fingers 28. A filling hole 43 for each lubricant reservoir 40 is formed in the main body 12 through the mating surface 20 and chamfered surface 27. Suitable closure means, such as a threaded cap or fitting 44 are used to threadably connect to the reservoir at the hole 43 to close the holes 43. The fitting 44 has a screwdriver slot for removal of the fittings. The fittings 44 each have a bore 47 formed therethrough allowing drilling fluid into the reservoir 40. A cylindrical floating piston 49 is slideable in and moves along the fluid reservoir 40. A bottom surface of the piston 49 applies a static pressure to the lubricant proportional to the weight of drilling fluid or mud on the piston 49. (FIG. 7). A rubber seal around the circumference of the piston 49 prevents mud from contaminating the lubricant.

The end of each cutter body shaft 39 is fixedly connected at support points 48 within the bore 37 of the fingers 28, to the main body structure 12. Adjacent the support points 48 at the shaft end near the thrust bearings 59 (FIG. 4), a lubricant entry groove 63 is formed in the shaft 39, which groove 63 is in fluid communication with the lubricant reservoir 40 through the lubricant passageway 41. An entry port 65 formed in the shaft 39 allows fluid from the lubricant passageway 41 to pass into a central longitudinal feed reservoir 66 formed along a portion of the length of each cutter body shaft 39. Each longitudinal feed reservoir 66 maintains a full level of lubricant as a result of the pressure maintained by the piston 49 on lubricant held in the lubricant reservoir 40, as previously discussed. A transverse exit feed port 67 projects from the longitudinal feed reservoir 66 of the cutter body shaft 39 to the surface of the shaft 39 at a point generally central with respect to the position of the roller bearings 60. It is through this second feed port 67 that the roller bearings 60, thrust bearing 59, and thrust washer 58 are lubricated.

In summary of the operation of the rotary drag bit 10, it is seen that a primary or circumferential rotational direction about axis 17 is imparted by the rotating drill string and bit 10 to move the fully offset cutter bodies 22 along their rotational axes 50 as indicated by arrow 19. A first abrasive or abrading mode of operation is applied along the length of each cutter body 22 by the flutes 25 of cutting elements 24 formed on the outside surface 53 of each of the cutter bodies 22 longitudinally intersecting the earth formation. The fully offset position, wherein the rotational axes 50 of the cutter bodies 20 are perpendicular to the longitudinal axis 17 of the drill string and bit 10 and each support point 48 of a given cutter body 22 is equidistant from the bit axis 17, is employed.

A second abrasive mode of operation helps gauge the bore 13 as seen in FIG. 3. As a result of the spiral or threaded orientation of the flutes 25 of cutting elements 24, secondary or radial rotation referenced to axis 17, induced by the primary rotation of each cutter body 22, and about the cutter body 22 rotational axis 50 takes place. As the cutter bodies 22 rotate, the cutting elements are periodically moved into and out of contact with the earth formation. As the cutter bodies 22 rotate under the secondary rotational motion, the flutes 25 laterally intersect the earth formation. Not only is the bore 13 gauged in the second abrasive mode, but additional material is abraded from the side and bottom of the bore as each element 24 passes through its complete rotation around the rotational axis 50.

The flutes 25 on the two cutter bodies 22 are mirror images of one another so that each cutter body 22 rotates about axis 50 toward the other cutter body 22. The nozzle 11 cleans the elements 24 as they pass beneath the nozzle and before re-contact is made with the earth formation.

The drilling fluids exit the bottom of the bore 13 through the junk slots 35 and 36, carrying cuttings from the bore 13. The fluid is returned to the surface for recycling and reuse.

Figure 12:
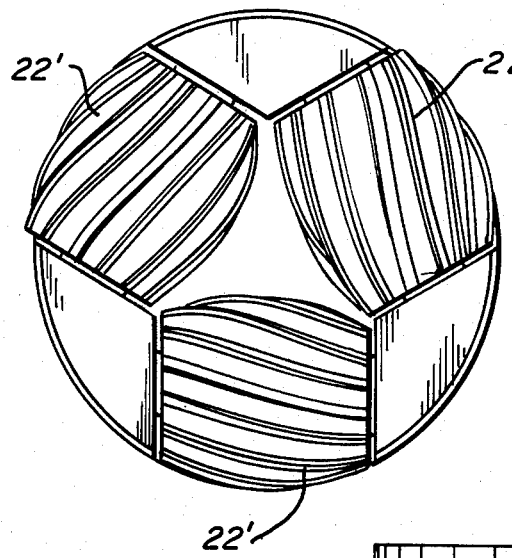
FIG. 12 is a bottom view of an alternative embodiment of the rotary drag bit with three cutter bodies.

In a first alternative embodiment seen in FIG. 12, like parts being given prime suffixes, three cutter bodies 22' are seen. In all other respects, the structure of FIG. 12 is as previously described.

Figure 13:
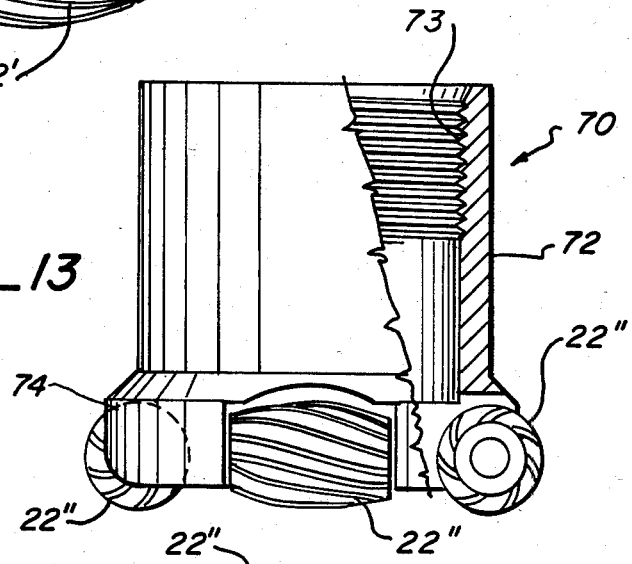
FIG. 13 is a fragmentary side elevational view of an alternative embodiment of the bit for a core bit.
Figure 14:
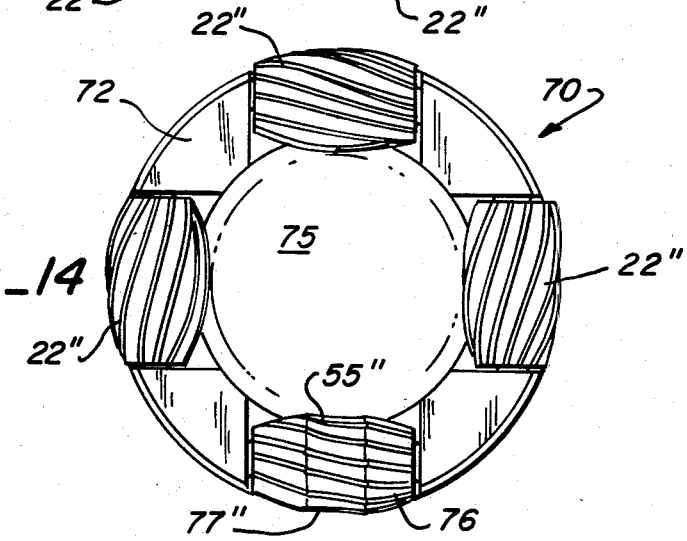
FIG. 14 is a bottom view of the core bit seen in FIG. 13.

A second alternative embodiment, seen in FIGS. 13 and 14 with like parts being given double prime suffixes, is used as a core bit 70. A body 72 of the core bit 70 is of elongated tubular construction with an internally threaded end 73 connected to a drill string (not shown). At a cutting end 74 of the core bit 70 are mounted four cutter bodies 22''.

The cutting end 74 of the body 72 widens outwardly to rotatably connect to the cutter bodies 22'' in a manner as previously described. A core 75 has a diameter defined by the distances between the innermost cutting of the cutter bodies 22''. An alternative cutter body 76 is seen to have a arcuate recess 77 around the periphery of the midportion 55''.

The present invention has been shown and described with a certain degree of specificity. It should be understood, however, that the specificity of the description has been made by way of example, and that the invention is defined by the scope of the appended claims.

What is claimed is:

1. A rotary drill bit for drilling in an earth formation which drill bit includes a main body structure, and at least one cutter body rotatably connected at each end thereof to the main body structure at an end support position at which end support position the cutter body is attached to the main body, said cutter body having a rotational axis perpendicular to and offset from a longitudinal axis of said drill bit, each of said end support positions being located on said rotational axis and equidistant from said longitudinal axis, said cutter body further having a generally ellipsoidal configuration with parallel rows of cutting elements formed on an outer surface thereof, said cutter body acting in the first abrasive mode of operation wherein the cutter body is moved in the direction of its rotational axis to abrade the earth formation and in a second abrasive mode of operation wherein said rows impart a rotation to said cutter bodies about their rotational axes to abrade said earth formation.

2. The invention as defined in claim 1 wherein said cutter body includes a bore having a roller bearing assembly mounted therein and a thrust bearing assembly mounted at the end which leads the cutter body in the direction of the rotational axis, said roller bearing assembly placed between said cutter body bore and a cutter body shaft, said shaft fixedly connected to said main body structure at said end supports.

3. The invention as defined in claim 2 wherein said main body structure includes a lubricant reservoir formed therein and means for applying pressure to said lubricant; said cutter body shaft having a passageway formed along a portion of the length thereof in fluid communication with said lubricant reservoir, said cutter body shaft including a port in fluid communication with said roller bearing assembly and said thrust bearing assembly for flow of said lubricant from said lubricant reservoir through said cutter body shaft to said roller bearings and thrust bearings.

4. The invention as defined in claim 3 wherein said cutter body shaft includes a lubricant groove and entry port in fluid communication with said lubricant reservoir for fluid communication with said shaft passageway.

5. The invention as defined in claim 3 wherein said means for applying pressure to said lubricant reservoir includes an elongated bore parallel to said bit axis, said bore having an opening at a top surface of said main body structure, said reservoir bore having a piston slideable there along abutting on a bottom surface said lubricant, and a fitting connected to said main body structure in said bore, said fitting having a fitting bore therethrough to allow pressure to be applied by drilling fluids to said piston.

6. The invention as defined in claim 1 wherein the cutter body cutting elements are aligned in rows so that threadable interaction results between each cutter body and the earth formation, the resultant cutter body rotation acts against a bottom of the well bore and then a side of the well bore in a gauge of the bore.

7. The invention as defined in claim 1 wherein said cutting elements are mounted at a spaced distance from said cutter body by integral flutes defining said rows.

8. A rotary drill bit having a longitudinal axis for drilling in an earth formation, which drill bit includes at least one cutter body connected at end supports at either end of said cutter body to a main body structure in a fixed operative position for rotation about a rotational axis of said cutter body defined by said end supports, said rotational axis offset from and perpendicular to said longitudinal axis, said cutter body having cutting elements connected to flutes projecting above an outer surface of said cutter body in rows generally parallel to said rotational axis from one end to another end of said cutter body, said cutter body moveable in a primary direction of rotation wherein said cutting element rows intersect and abrade the earth formation generally along the rows and the longitudinal axis, and a secondary rotation induced by said primary rotation wherein said rows laterally intersect and abrade said earth formation.

9. The invention as defined in claim 8 wherein said cutting elements are projecting teeth selected from the group consisting of natural diamond, polycrystalline diamond stud and carbonade diamond.

10. The invention as defined in claim 8 wherein said cutting elements are projecting teeth selected from the group consisting of aluminum oxide, tungsten carbide and borazon.

11. The invention as defined in claim 8 wherein said cutting elements are small diamond chips connected to said flutes.

12. The invention as defined in claim 8 wherein said cutting elements are laminated polycrystalline diamond embedded in said flutes.

13. The invention as defined in claim 8 wherein said cutter body has a thickness at a mid portion greater than a thickness at an end portion.

14. The invention as defined in claim 8 wherein each of said cutter bodies has a bore formed along the length thereof for receipt of a shaft, said shaft fixedly connected to said main body structure at an end support position and having a roller bearing assembly mounted intermediate said shaft and said cutter body bore, said shaft further having formed there around an annular thrust bearing fitted into a counter sunk bore at an end of said cutter body which end precedes said cutter body in said primary rotational direction.

15. The invention as defined in claim 14 wherein said main body structure includes one lubricant reservoir for each cutter body in fluid communication with said shaft, said shaft having passageways formed therein in fluid communication with said roller bearing assembly and said thrust bearing.

16. The invention as defined in claim 15 wherein each of said lubricant reservoirs is formed in said main body structure near said preceding end of each cutter body, each lubricant reservoir in fluid communication with said cutter body shaft through a fluid passageway, each of said fluid passageways passing through said main body structure and said shaft to an elongated feed reservoir extending substantially the length of said shaft and having transverse ports for passing lubricant to said roller bearings and said thrust bearing.

17. The invention as defined in claim 16 wherein said lubricant reservoir includes a means for forcing said lubricant through said passageways into fluid communication with said roller bearings and thrust bearing.

18. The invention as defined in claim 17 wherein said means for forcing lubricant include a piston slideable along said lubricant reservoir in an essentially sealed relationship and a fitting secured to said main body having a fitting bore therethrough for allowing drilling fluid to pass into said reservoir and apply pressure to a top surface of said piston.

19. A rotary drill bit for drilling in an earth formation, which drill bit includes a main body structure and at least one cutter body connected to the main body structure by an end support at each end of the cutter body, a plurality of cutter elements connected to said cutter body in spaced apart flutes on an outer surface of said cutter body, said flutes generally parallel to each other and to a rotational axis of said cutter body and extending along a line in a continuously changing angle with respect to a straight line, parallel to said rotational axis, connecting the ends of the cutter body, said rotational axis being perpendicular to and offset from a longitudinal axis of said drill bit, each end support of said cutter body being of essentially equal distance from said drill bit longitudinal axis, whereby rotation of said drill string in a primary direction about said longitudinal axis rotates said cutter body in a secondary rotational direction about its own rotational axis to abrade the earth formation.

20. The invention as defined in claim 19 wherein said cutter body and main body further includes a roller bearing assembly and means for lubricating said roller bearing assembly.

21. In a drag type of rotary drill bit having a longitudinal axis and abrasive cutting elements rotatable about a rotational axis, said drill bit for drilling a bore into an earth formation by shearing cutting action on the earth formation, an improvement and combination therewith comprising:

means for periodically moving each of said abrasive cutting elements about said rotational axis and into and out of contact with said earth formation during primary rotation of said drill bit in contact with the earth formation, said rotational axis offset from and perpendicular to said longitudinal axis, said periodic moving means further imparting both a radial component of abrading movement in the direction of primary rotation along the rotational axis and a circumferential component of abrading movement about said rotational axis to each cutting element in contact with the earth formation, the circumferential component being greater than the radial component.

22. The invention as defined in claim 21 wherein said abrasion cutting elements are mounted on at least one cutter body rotatively connected to a main body structure of said drill bit, said cutter body rotated by said drill bit rotation.

23. The invention as defined in claim 22 wherein said cutter body has helical spiral flutes formed on an exterior surface thereof and along the length of said cutter bodies, said flutes inducing a rotation of the cutter body about a rotational axis.

24. The invention as defined in claim 23 wherein there are two cutter bodies and the flutes of each of said cutter bodies spiral in directions opposite to the other of said flutes.

25. The invention as defined in claim 23 wherein there are two cutter bodies, each of said cutter bodies having a different number of flutes.

26. The invention as defined in claim 22 wherein the rotational axis of each of said cutter bodies is perpendicular to a radial line extending from a longitudinal axis of the rotary drill bit and has a rotational end support at each end on the rotational axis of said cutter bodies which end supports are each equi-distant from any point on said longitudinal drill bit axis.

27. The invention as defined in claim 22 wherein said cutter bodies are of ellipsoid shape having truncated ends.

28. In a drag type rotary drill bit having abrasive cutting elements for drilling an earth formation by shearing cutting action on the earth formation, an improvement and combination therewith comprising at least one cutter body rotatively mounted to a main body structure of said rotary drill bit, said cutter body having spiral flutes extending along the length of said cutter body, said flutes having abrasive cutting elements operatively associated therewith, said cutter bodies being rotated during a primary rotation of said drill bit into contact with the earth formation, said flutes contacting said earth formation to move said cutter body about a rotational axis of said cutter body offset from and perpendicular to a longitudinal axis of said drill bit, said primary rotation and said movement about said rotational axis imparting both a radial and a circumferential component of abrading movement to each cutting element while in contact with the earth formation, the circumferential component being greater than the radial component.

29. A rotary drill bit for drilling in an earth formation, which drill bit includes at least one cutter body having a bore formed along the length thereof for receipt of a shaft, said shaft fixedly connected to a main body structure at either end of said shaft at an end support position, a roller bearing assembly mounted intermediate said shaft and said cutter body bore, said shaft further having formed therearound an annular thrust bearing fitted into a counter-sunk bore, said cutter body having cutting elements connected to flutes projecting above an outer surface of said cutter body in rows from one end to another end of said cutter body, said cutter body moveable in a primary direction of rotation wherein said cutting element rows intersect and abrade the earth formation generally along the row and in a secondary rotation induced by said primary rotation wherein said rows laterally intersect and abrade said earth formation, said thrust bearing mounted at the end of said cutter body which precedes said cutter body in the primary rotational direction.

30. The invention as defined in claim 29 wherein said main body structure includes one lubricant reservoir for each cutter body in fluid communication with said shaft, said shaft having passageways formed therein in fluid communication with said roller bearing assembly and said thrust bearing.

31. The invention as defined in claim 30 wherein each of said lubricant reservoirs is formed in said main body structure near said preceding end of said cutter body, each lubricant reservoir in fluid communication with said cutter body shaft through a fluid passageway, each of said fluid passageways passing through said main body structure and said shaft to an elongated feed reservoir extending substantially the length of said shaft and having transverse ports for passing lubricant to said roller bearings and said thrust bearing.

32. The invention as defined in claim 31 wherein said lubricant reservoir includes a means for forcing said lubricant through said passageways into fluid communication with said roller bearings and thrust bearing.

33. The invention as defined in claim 32 wherein said means for forcing lubricant includes a piston slideable along said lubricant reservoir in an essentially sealed relationship and a fitting secured to said main body having a fitting bore therethrough for allowing drilling fluid to pass into said reservoir and apply pressure to a top surface of said piston.

* * * * *

UNITED STATES PATENT AND TRADEMARK OFFICE

CERTIFICATE OF CORRECTION

PATENT NO. : 4,552,232

DATED : November 12, 1985

INVENTOR(S) : Lawrence Frear

It is certified that error appears in the above-identified patent and that said Letters Patent is hereby corrected as shown below:

Column 7, line 61,"precede" should read -- trail --.

Claim 2, line 6, "leads" should read -- trails --.

Claim 14, line 20, "precedes" should read -- trails --.

Signed and Sealed this

Ninth Day of May, 1989

*Attest:*

DONALD J. QUIGG

*Attesting Officer*

*Commissioner of Patents and Trademarks*